US012540542B2

(12) United States Patent
Alajmi et al.

(10) Patent No.: US 12,540,542 B2
(45) Date of Patent: Feb. 3, 2026

(54) CONTROLLING LOGGING TOOL ORIENTATION IN A WELLBORE

(71) Applicant: Saudi Arabian Oil Company, Dhahran (SA)

(72) Inventors: Nadir Abdullah Alajmi, Al-Khobar (SA); Mustafa Alhuwaider, Dhahran (SA); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/769,886

(22) Filed: Jul. 11, 2024

(65) Prior Publication Data

US 2026/0015936 A1 Jan. 15, 2026

(51) Int. Cl.
*E21B 47/024* (2006.01)
*E21B 17/10* (2006.01)

(52) U.S. Cl.
CPC ..... *E21B 47/024* (2013.01); *E21B 17/1028* (2013.01)

(58) Field of Classification Search
CPC ..... E21B 47/024; E21B 23/001; E21B 23/14
See application file for complete search history.

(56) References Cited

U.S. PATENT DOCUMENTS

| | | | |
|---|---|---|---|
| 4,410,051 | A | 10/1983 | Daniel et al. |
| 4,637,478 | A | 1/1987 | George |
| 5,040,619 | A | 8/1991 | Jordan et al. |
| 5,964,294 | A | 10/1999 | Edwards |
| 6,173,773 | B1 | 1/2001 | Almaguer et al. |
| 10,161,246 | B1 | 12/2018 | Hay et al. |
| 11,015,447 | B2 | 5/2021 | Zainalabedin et al. |
| 11,313,225 | B2 | 4/2022 | Zainalabedin et al. |
| 11,414,961 | B1 | 8/2022 | Al-Huwaider et al. |
| 11,460,443 | B2 | 10/2022 | Al-Huwaider et al. |
| 11,536,135 | B2 | 12/2022 | Al-Huwaider et al. |
| 11,578,585 | B2 | 2/2023 | Al-Huwaider et al. |
| 11,661,844 | B2 | 5/2023 | Al-Huwaider et al. |
| 11,679,977 | B2 | 6/2023 | Al-Huwaider et al. |
| 11,680,484 | B2 | 6/2023 | Al-Huwaider et al. |

(Continued)

FOREIGN PATENT DOCUMENTS

| | | |
|---|---|---|
| EP | 3921503 | 6/2023 |
| GB | 2390623 | 1/2004 |
| WO | WO 2002061235 | 8/2002 |

*Primary Examiner* — David Carroll
(74) *Attorney, Agent, or Firm* — Fish & Richardson P.C.

(57) ABSTRACT

A downhole orientation tool includes a top sub-assembly configured to couple to a downhole conveyance and run into a wellbore on the downhole conveyance from a terranean surface to one or more subterranean formations; one or more orientation sensors coupled to the top sub-assembly and configured to detect rotational motion of the tool during running in the wellbore; an orientation motor coupled to the one or more orientation sensors and configured to axially rotate the tool in the wellbore in response to the detected rotational motion of the tool during running in the wellbore to orient the tool at a particular axial orientation during running in the wellbore; and a tractor coupled to the top sub-assembly, the one or more orientation sensors, and the orientation motor and configured to provide motive force to move the tool through the wellbore.

28 Claims, 3 Drawing Sheets

(56) References Cited

U.S. PATENT DOCUMENTS

| | | | | |
|---|---|---|---|---|
| 11,713,651 | B2 | 8/2023 | Al-Huwaider et al. | |
| 11,802,827 | B2 | 10/2023 | Al-Huwaider et al. | |
| 11,933,140 | B2 | 3/2024 | Al-Huwaider et al. | |
| 11,952,885 | B2 | 4/2024 | Al-Huwaider et al. | |
| 12,024,430 | B2 | 7/2024 | Al-Huwaider et al. | |
| 12,031,395 | B2 | 7/2024 | Al-Huwaider et al. | |
| 12,049,807 | B2 | 7/2024 | Al-Nasser et al. | |
| 2003/0188867 | A1 | 10/2003 | Parrott et al. | |
| 2009/0151588 | A1 | 6/2009 | Burleson et al. | |
| 2010/0230163 | A1 | 9/2010 | Hales et al. | |
| 2021/0246782 | A1* | 8/2021 | Eng | G01B 17/00 |
| 2022/0316318 | A1* | 10/2022 | Almulhim | G01V 9/00 |
| 2022/0335253 | A1 | 10/2022 | Xu et al. | |
| 2023/0036144 | A1* | 2/2023 | AlSultan | E21B 47/06 |
| 2023/0314401 | A1 | 10/2023 | Alqunais et al. | |
| 2024/0192038 | A1 | 6/2024 | Al-Huwaider et al. | |
| 2024/0271520 | A1 | 8/2024 | Al-Huwaider et al. | |
| 2025/0101826 | A1* | 3/2025 | Haugland | E21B 23/14 |
| 2025/0116185 | A1* | 4/2025 | Saumya | E21B 47/006 |

* cited by examiner

CONTROLLING LOGGING TOOL ORIENTATION IN A WELLBORE

TECHNICAL FIELD

This disclosure relates to apparatus, systems, and methods for logging a well and more particularly, apparatus, systems, and methods for controlling logging tool orientation in a wellbore.

BACKGROUND

Downhole logging tools can provide information regarding a subterranean formation, borehole conditions, integrity of a well completion, or a combination thereof. The orientation of subterranean logging tools usually changes while running within the wellbore due to many factors, such as borehole rugosity and tortuosity, scale, friction, and deviation. Such factors can force the tool to uncontrollably change its orientation in the wellbore.

SUMMARY

In an example implementation, a downhole orientation tool includes a top sub-assembly configured to couple to a downhole conveyance and run into a wellbore on the downhole conveyance from a terranean surface to one or more subterranean formations; one or more orientation sensors coupled to the top sub-assembly and configured to detect rotational motion of the tool during running in the wellbore; an orientation motor coupled to the one or more orientation sensors and configured to axially rotate the tool in the wellbore in response to the detected rotational motion of the tool during running in the wellbore to orient the tool at a particular axial orientation during running in the wellbore; and a tractor coupled to the top sub-assembly, the one or more orientation sensors, and the orientation motor and configured to provide motive force to move the tool through the wellbore.

An aspect combinable with the example implementation includes a multi-finger caliper sub-assembly coupled to the orientation motor and configured to measure an inner radial dimension of a wellbore tubular installed in the wellbore.

Another aspect combinable with one, some, or all of the previous aspects includes a flexibility spring coupled between the multi-finger caliper sub-assembly and the orientation motor.

In another aspect combinable with one, some, or all of the previous aspects, the flexibility spring is configured to adjust an orientation of the multi-finger caliper sub-assembly in response to one or more external forces that act on the tool during running in the wellbore.

Another aspect combinable with one, some, or all of the previous aspects includes a centralizer coupled between the top sub-assembly and the tractor.

In another aspect combinable with one, some, or all of the previous aspects, the centralizer is configured to radially centralize the tool in the wellbore during running in the wellbore.

In another aspect combinable with one, some, or all of the previous aspects, the one or more orientation sensors includes one or more gyroscopes configured detect the rotational motion of the tool during running in the wellbore.

Another aspect combinable with one, some, or all of the previous aspects includes a bottom sub-assembly configured to couple to a logging tool.

In another aspect combinable with one, some, or all of the previous aspects, the top sub-assembly is configured to couple to the downhole conveyance through a logging tool.

In another aspect combinable with one, some, or all of the previous aspects, the tractor includes a motor and a plurality of retractable arms, and each retractable arm includes at least one roller configured to exert the motive force on the wellbore or a wellbore tubular to move the tool through the wellbore in response to operation of the motor.

Another aspect combinable with one, some, or all of the previous aspects includes a controller communicably coupled to the one or more orientation sensors, the orientation motor, and the multi-finger caliper sub-assembly.

In another aspect combinable with one, some, or all of the previous aspects, the controller is configured to perform operations including determining a metal loss of the wellbore tubular based on the measured inner radial dimension of the wellbore tubular, a baseline inner radial dimension of the wellbore tubular, a nominal outer radius of the wellbore tubular, and an average inner radial dimension of the wellbore tubular.

In another aspect combinable with one, some, or all of the previous aspects, the operation of determining the metal loss includes solving $$\text{Metal Loss } (TL) = \frac{IRMax_{MonitorLog} - IRMax_{BaseLog}}{OR_{nom} - IRAvg_{BaseLog}} \times 100,$$

where Metal Loss (TL) is the metal loss of the wellbore tubular, $IRMax_{MonitorLog}$ is the measured inner radial dimension of the wellbore tubular, $IRMax_{BaseLog}$ is the baseline inner radial dimension of the wellbore tubular, $OR_{Nom}$ is the nominal outer radius of the wellbore tubular, and $IRAvg_{BaseLog}$ is the average inner radial dimension of the wellbore tubular.

In another aspect combinable with one, some, or all of the previous aspects, the operations include generating a base log during an initial running of the tool in the wellbore, the base log including a log of wellbore orientation relative to wellbore depth exclusive of operation of the orientation motor.

In another aspect combinable with one, some, or all of the previous aspects, the operations include generating at least one secondary log during at least one secondary running of the tool in the wellbore subsequent in time to the initial running of the tool in the wellbore, the at least one secondary log including a log of wellbore orientation relative to wellbore depth while operating the orientation motor to axially rotate the tool in the wellbore in response to the detected rotational motion of the tool during the at least one secondary running of the tool in the wellbore to orient the tool to minimize a wellbore orientation difference between the at least one secondary log and the base log.

In another aspect combinable with one, some, or all of the previous aspects, the operations include generating an output that includes a wellbore orientation index that defines the wellbore orientation difference between the at least one secondary log and the base log.

In another aspect combinable with one, some, or all of the previous aspects, the wellbore orientation index is between 0 and ±180 degrees.

In another aspect combinable with one, some, or all of the previous aspects, the at least one secondary log includes a plurality of secondary logs, and each of the plurality of secondary logs is generated during a unique logging time subsequent in time to the initial running of the tool in the wellbore.

In another aspect combinable with one, some, or all of the previous aspects, the downhole conveyance includes a wireline.

In another example implementation, a method includes running a downhole orientation tool on a downhole conveyance into a wellbore from a terranean surface to one or more subterranean formations. The downhole orientation tool includes one or more orientation sensors, an orientation motor coupled to the one or more orientation sensors, and a tractor coupled to the top sub-assembly, the one or more orientation sensors, and the orientation motor and configured to provide motive force to move the tool through the wellbore. The method includes during the running, detecting rotational motion of the tool with the one or more orientation sensors; and in response to the detected rotational motion of the tool during running in the wellbore, axially rotating at least a portion of the tool in the wellbore with the orientation motor to orient the portion of the tool at a particular axial orientation during running in the wellbore.

An aspect combinable with the example implementation includes measuring an inner radial dimension of a wellbore tubular installed in the wellbore with a multi-finger caliper sub-assembly coupled to the orientation motor.

Another aspect combinable with one, some, or all of the previous aspects includes adjusting an orientation of the multi-finger caliper sub-assembly in response to one or more external forces that act on the tool during running in the wellbore with a flexibility spring coupled between the multi-finger caliper sub-assembly and the orientation motor.

Another aspect combinable with one, some, or all of the previous aspects includes radially centralizing the tool in the wellbore during running in the wellbore with a centralizer coupled between the top sub-assembly and the tractor.

In another aspect combinable with one, some, or all of the previous aspects, detecting rotational motion of the tool with the one or more orientation sensors includes detecting rotational motion of the tool with one or more gyroscopes.

Another aspect combinable with one, some, or all of the previous aspects includes, during running the downhole orientation tool on the downhole conveyance into the wellbore, logging the wellbore with a logging tool coupled to at least one of the downhole conveyance or the downhole orientation tool.

Another aspect combinable with one, some, or all of the previous aspects includes moving the downhole orientation tool through the wellbore with the tractor exclusive of gravity acting on the tool.

In another aspect combinable with one, some, or all of the previous aspects, moving the downhole orientation tool through the wellbore with the tractor exclusive of gravity acting on the tool includes extending a plurality of retractable arms of the tractor to contact an inner radial surface of the wellbore or a wellbore tubular; operating a motor of the tractor to operate at least one roller on each retractable arm that is in contact with the wellbore or the wellbore tubular; and exerting motive force on the wellbore or the wellbore tubular to move the tool through the wellbore with the rollers.

In another aspect combinable with one, some, or all of the previous aspects, the downhole orientation tool includes a controller communicably coupled to the one or more orientation sensors, the orientation motor, and the multi-finger caliper sub-assembly, and the method includes determining, with the controller, a metal loss of the wellbore tubular based on the measured inner radial dimension of the wellbore tubular, a baseline inner radial dimension of the wellbore tubular, a nominal outer radius of the wellbore tubular, and an average inner radial dimension of the wellbore tubular.

In another aspect combinable with one, some, or all of the previous aspects, determining the metal loss includes solving, with the controller, $$\text{Metal Loss } (TL) = \frac{IRMax_{MonitorLog} - IRMax_{BaseLog}}{OR_{nom} - IRAvg_{BaseLog}} \times 100,$$

where Metal Loss (TL) is the metal loss of the wellbore tubular, $IRMax_{MonitorLog}$ is the measured inner radial dimension of the wellbore tubular, $IRMax_{BaseLog}$ is the baseline inner radial dimension of the wellbore tubular, $OR_{Nom}$ is the nominal outer radius of the wellbore tubular, and $IRAvg_{BaseLog}$ is the average inner radial dimension of the wellbore tubular.

Another aspect combinable with one, some, or all of the previous aspects includes generating, with the controller, a base log during an initial running of the tool in the wellbore, the base log including a log of wellbore orientation relative to wellbore depth exclusive of operation of the orientation motor.

Another aspect combinable with one, some, or all of the previous aspects includes generating, with the controller, at least one secondary log during at least one secondary running of the tool in the wellbore subsequent in time to the initial running of the tool in the wellbore, the at least one secondary log including a log of wellbore orientation relative to wellbore depth while operating the orientation motor to axially rotate the tool in the wellbore in response to the detected rotational motion of the tool during the at least one secondary running of the tool in the wellbore to orient the tool to minimize a wellbore orientation difference between the at least one secondary log and the base log.

Another aspect combinable with one, some, or all of the previous aspects includes generating, with the controller, an output that includes a wellbore orientation index that defines the wellbore orientation difference between the at least one secondary log and the base log.

In another aspect combinable with one, some, or all of the previous aspects, the wellbore orientation index is between 0 and ±180 degrees.

In another aspect combinable with one, some, or all of the previous aspects, the at least one secondary log includes a plurality of secondary logs, and each of the plurality of secondary logs is generated during a unique logging time subsequent in time to the initial running of the tool in the wellbore.

Example implementations of a downhole orientation tool according to the present disclosure can include one, some, or all of the following features. For example, implementations according to the present disclosure can provide for full radial coverage and maintain an orientation reference recorded for directing the tool and for future time-laps to, for instance, ensure consistency of data interpretation across multiple logging runs. As another example, implementations according to the present disclosure can maintain centralization and provide better logging tools shuttling performance in directional wells. As a further example, implementations according to the present disclosure can minimize stuck pipe risks since additional forces can be applied. Also, implementations according to the present disclosure can optimize a number of wireline logging trips, which can save time and costs.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes implementations of a downhole orientation tool and methods performed therewith to characterize a wellbore or a wellbore tubular (for example, production casing, production tubing, or otherwise) installed in a wellbore or cement and cement quality behind a wellbore tubular. In example aspects, the downhole orientation tool can be operated with a relatively high degree of precision to characterize the wellbore or the wellbore tubular tool, as well as adjust or control an orientation of logging tool that is part of the downhole orientation tool or coupled to the downhole orientation tool within a downhole conveyance during running of the conveyance (and the downhole orientation tool) through the wellbore. In some aspects, the downhole orientation tool can control or help control an axial orientation (in other words, orientation about an axis that extends in the direction of the wellbore) of a logging tool. Such orientation can often change while running due to many factors, such as borehole tortuosity, scale, friction, deviation, or a combination thereof, which forces the logging tool to uncontrollably change its orientation. As such, operation of example aspects of the downhole orientation tool according to the present disclosure can orient a logging tool to be precisely and actively oriented to a specific point of reference (for example, north or another direction) In some aspects, by correctly orienting a logging tool with the downhole orientation tool, time-lapse surveys (for example, well integrity multi-finger caliper logs and other formation evaluation and reservoir surveillance logs) can be compared more consistently and accurately.

In example aspects of a downhole orientation tool according to the present disclosure, other measurements, such as electromagnetic for pipe corrosion evaluation can also be assisted by orientation of the logging tool with the downhole orientation tool in the wellbore. In some aspects, the downhole orientation tool can operate to orient itself and the logging tool within a set mechanical force cutoff, such that when that force cutoff is exceeded, the downhole orientation tool operates to orient as close as possible to the point of reference while also recording a degree of deviation from the point of reference (which can be useful to diagnose wellbore conditions).

Figure 1:
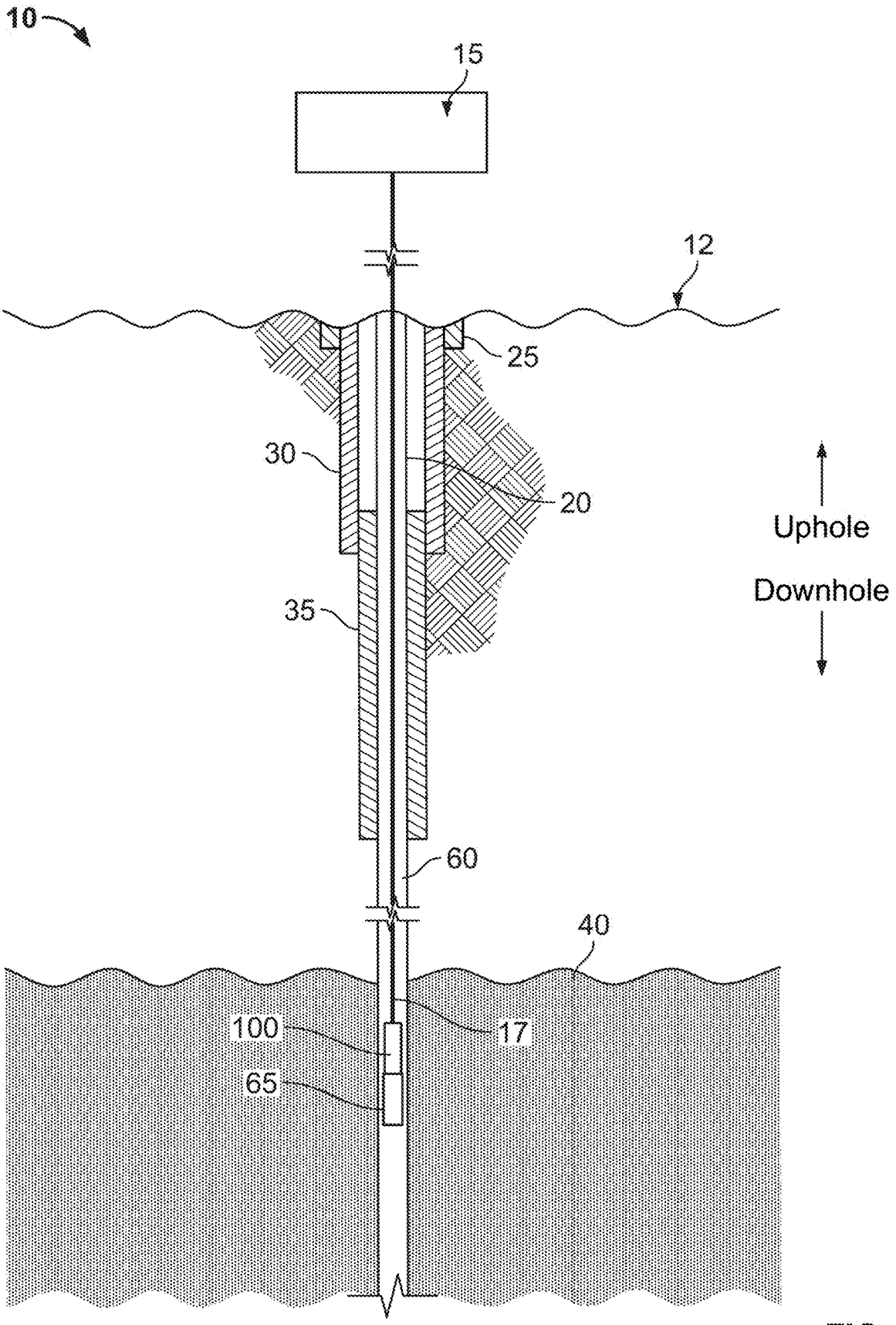
FIG. 1 is a schematic diagram of an example wellbore system that includes a downhole orientation tool according to the present disclosure.

As illustrated in FIG. 1, an implementation of a wellbore system 10 includes a logging assembly (or "assembly") 15 deployed on a terranean surface 12. The logging assembly 15 can generally represent a system for logging a wellbore 20 formed into one or more subterranean formations for the purpose of, for example, producing hydrocarbon fluids from the formations to the terranean surface 12. Wellbore 20 extends from the terranean surface 12 and through one or more geological formations in the Earth and into subterranean formation 40 that is located under the terranean surface 12. One or more wellbore casings, such as a surface casing 30 and intermediate casing 35, may be installed in at least a portion of the wellbore 20 (for example subsequent to completion of the drilling operation or some other time). In some aspects, however, all or part of the wellbore 20 can be an open hole wellbore, in which no casings or other wellbore tubulars form a barrier to the subterranean formation 40 (also called a reservoir rock formation).

Generally, the assembly 15 may be any appropriate logging assembly or rig used to, for example, log wellbores or boreholes in the Earth or otherwise provide for access to subterranean formation 40. The wellbore 20 can be formed with traditional or nontraditional or novel techniques. In some embodiments, rotary drilling equipment can be used to form the wellbore 20 and other, non-rotary drilling techniques. Rotary drilling equipment is known and may consist of a drill string and a drill bit (or bottom hole assembly that includes a drill bit). Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to a drill bit.

In some embodiments, the assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

As shown in FIG. 1, the logging assembly 15 includes a downhole orientation tool 100 that is coupled to a downhole conveyance 17, such as a wireline or other conveyance. In this example, a logging tool 65 is coupled to the downhole orientation tool 100 at a downhole end of the downhole orientation tool 100. Alternatively, the logging tool 65 can be coupled to the downhole conveyance 17 at a location uphole of the downhole orientation tool 100.

Figure 2:
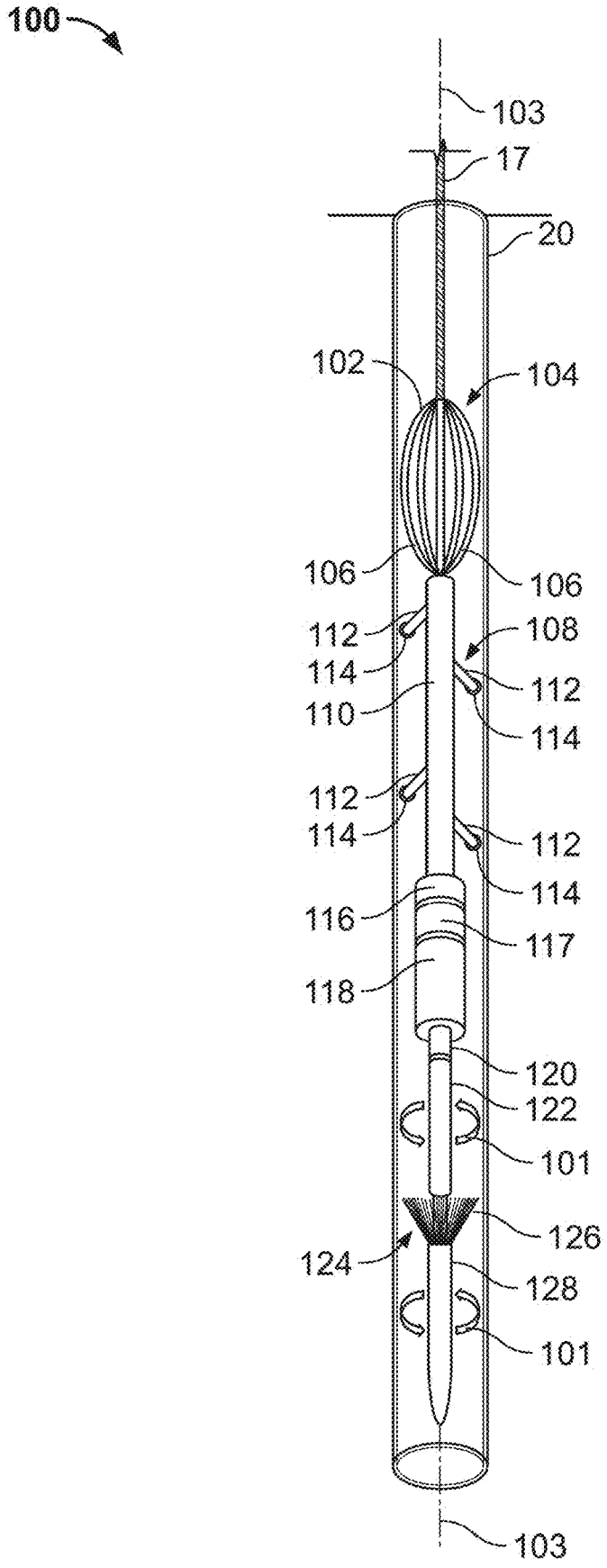
FIG. 2 is a schematic diagram of an example implementation of a downhole orientation tool according to the present disclosure.

FIG. 2 is a schematic diagram of an example implementation of the downhole orientation tool 100 according to the present disclosure. As shown in this example implementation, the downhole orientation tool 100 includes a top-sub assembly 102 (such as a threaded or other connection) that couples the downhole orientation tool 100 to the downhole conveyance 17 within the wellbore 20 (or a wellbore tubular that can also be represented by 20). As shown here, the downhole orientation tool 100 is run into the wellbore 20 parallel to or along an axis 103 that extends through a centerline of the wellbore 20 (whether it is vertical, horizontal, directional, or otherwise). The downhole conveyance 17, in this example, is a wireline that provides power as well as data transmission to and from the downhole orientation tool 100 and the terranean surface 12 (such as the logging assembly 15).

In this example, a centralizer 104 that includes multiple bow springs 106 is coupled to the top sub-assembly 102. Generally, the centralizer 104 provides tool centralization and stability of the downhole orientation tool 100 on the axis 103 and within the wellbore 20. In some aspects, the bow springs 106 can flex to contact the wellbore 20 (or wellbore tubular) as the downhole orientation tool 100 moves through the wellbore 20 on the downhole conveyance 17.

The example implementation of the downhole orientation tool 100 also includes a tractor (or traction tool) 108 coupled to the centralizer 104. In this example, the tractor 108 includes multiple, extendable and retractable arms 112, each of which includes a roller 114 (or wheel) that can be driven by a motor 110 of the tractor 108 to move the downhole orientation tool 100 through the wellbore 20 (or a wellbore tubular). For instance, the motor 110 can receive electrical power and control signals from the wireline 17 to turn on or off, depending on whether the downhole orientation tool 100 needs to be moved absent a gravitational force that also can move the downhole orientation tool 100. For instance, in the case of the downhole orientation tool 100 moving through a vertical wellbore 20 (in a downhole direction), the tractor 108 may be inoperable, with the arms 112 retracted such that the rollers 114 are not in contact with the wellbore 20. However, when the downhole orientation tool 100 moves through a directional or horizontal portion of wellbore 20, the tractor 108 can be activated to extend the arms 112 such that the rollers 114 are in contact with the wellbore 20 and provide the motive force to move the downhole orientation tool 100 through the wellbore 20. In some aspects, in the case of the downhole conveyance 17 being a wireline or slickline, the tractor 108 can be deployed to move the downhole orientation tool 100 through a directional or horizontal portion of a wellbore (or both) and to provide an axial grip against the wellbore 20 to help ensure or ensure proper rotation of an orientation motor 118 (described later).

As shown in this example, an orientation sensor 116 (or one or more orientation sensors 116) is coupled to the tractor 108. In an example implementation, the orientation sensor 116 includes one or more gyroscope sensors that can measure rotational motion of the downhole orientation tool 100 about axis 103 that can be used as a reference and a guide to orient the downhole orientation tool 100 (and, for example, a logging tool coupled to the downhole orientation tool 100) to a desired orientation while logging uphole or downhole. In some aspects, the orientation sensor 116 can provide an output of the orientation of the downhole orientation tool 100 during stationary logging at specific orientation (or to provide 360° coverage).

Coupled with the orientation sensor 116, as shown, is an orientation motor 118. The orientation motor 118, in some aspects, receives power from the wireline 17 and generates axial rotation 101 to at least a portion of the downhole orientation tool 100, such as the portion that includes a flexibility spring 120, a connector 122, a caliper sub-assembly 124, and a bottom sub-assembly 128. In some aspects, control of the orientation motor 118 to provide the rotation 101 can be initiated with the orientation sensor 116 and is based on a measured orientation of the downhole orientation tool 100 in the wellbore 20 (relative to a predetermined or reference orientation). In some aspects, the flexibility spring 120 can also allow some axial rotation caused by external wellbore forces due to tortuosity, scale, etc. of the wellbore 20, which forces the downhole orientation tool 100 to rotate. This flexibility in the spring 120 can prevent the downhole orientation tool 100 from getting stuck, for example, due to the orientation motor 118 operating to keep the downhole orientation tool 100 oriented to a specific direction or point of reference. In some aspects, a rating of the flexibility spring 120 can be optimized based on expected wellbore conditions.

In some aspects, control of the orientation motor 118 can be performed with a controller 117 (for example, a microprocessor based controller, ASIC, PCB, or otherwise) that is communicably coupled to the orientation sensor 116 (for example, to receive the measured orientation and determine its difference relative to the predetermined or reference orientation). Based on the difference (or other criteria), the controller 117 can activate or deactivate the orientation motor 118 to provide the rotation 101 to change the orientation of the downhole orientation tool 100 to the predetermined or reference orientation.

The caliper sub-assembly 124 includes multiple fingers 126 that extend from the downhole orientation tool 100 to contact the wellbore 20 during running (uphole or downhole). By contacting the wellbore 20 (or wellbore tubular), the caliper sub-assembly 124 can act as a corrosion detection tool that measures internal metal loss of a wellbore tubular. In some aspects, an orientation of the caliper sub-assembly 124 (as controlled by the orientation motor 118) can have an impact in data acquisition and corrosion progression time laps. By controlling the orientation of the downhole orientation tool 100 to a specific point of reference using, for example, a combination of the tractor 108, the orientation sensor 116, and the orientation motor 118, the fingers 126 are ensured to pass and read through the same wellbore path from one run of the downhole orientation tool 100 to another run (and multiple runs) of the downhole orientation tool 100. In the multiple runs, by having the same orientation readings, a specific corrosion progression can be monitored to avoid the possibility of skipping any anomalies between the caliper fingers 126. Also, orientation changes during quality check runs can be avoided. In addition, the orientation of the downhole orientation tool 100 can be controllably changed (for example, by operation of the tractor 108, the orientation sensor 116, and the orientation motor 118) to have the caliper sub-assembly 124 cover the uncovered surfaces of the wellbore 20 (or wellbore tubular) in-between the fingers 126 from other passes.

Through at least one run, the caliper sub-assembly 124 can be used to detect metal loss of a wellbore tubular, as well as determine a shape of the wellbore 20 (or wellbore tubular). For example, metal loss can be determined based on a measured inner radial dimension of a wellbore tubular (through the run(s)), a baseline inner radial dimension of the wellbore tubular (determined by a first run in a new or uncorroded wellbore tubular), a nominal outer radius of the wellbore tubular (as provided by a manufacturer of the wellbore tubular), and an average inner radial dimension of the wellbore tubular (through the length of a new or uncorroded wellbore tubular). These variables can be expressed as:

$$\text{Metal Loss } (TL) = \frac{IRMax_{MonitorLog} - IRMax_{BaseLog}}{OR_{nom} - IRAvg_{BaseLog}} \times 100. \quad \text{Eq. 1}$$

In Eq. 1, Metal Loss (TL) is the metal loss of the wellbore tubular, $IRMax_{MonitorLog}$ is the measured inner radial dimension of the wellbore tubular, $IRMax_{BaseLog}$ is the baseline inner radial dimension of the wellbore tubular, $OR_{Nom}$ is the nominal outer radius of the wellbore tubular, and $IRAvg_{BaseLog}$ is the average inner radial dimension of the wellbore tubular.

Figure 3:
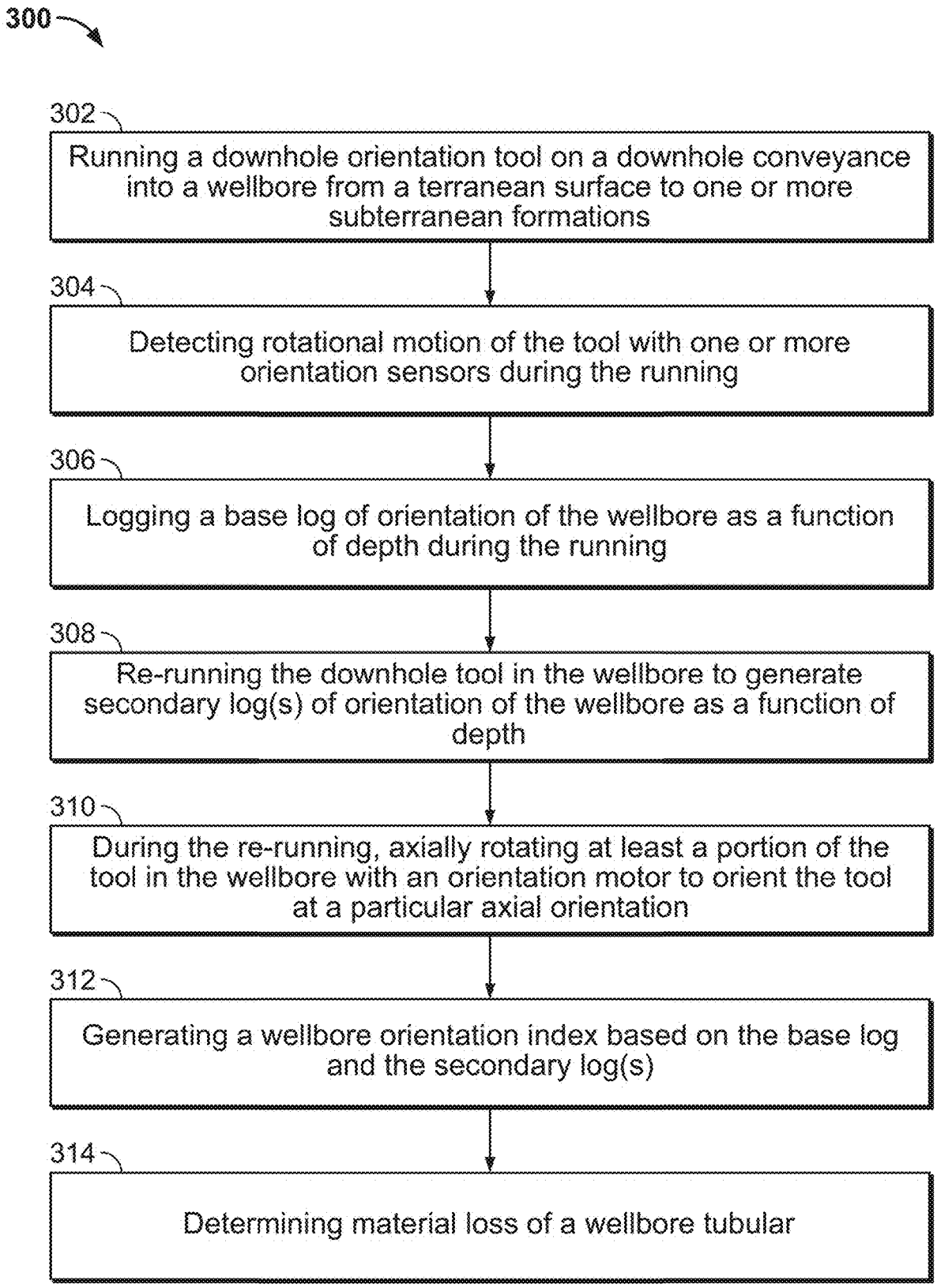
FIG. 3 is a flowchart of an example process for operating a downhole orientation tool during a logging operation according to the present disclosure.

FIG. 3 is a flowchart of an example method 300 for operating the downhole orientation tool 100 during a logging operation according to the present disclosure. Method 300 can begin at step 302, which includes running a downhole orientation tool (for example, downhole orientation tool 100) on a downhole conveyance 17 into a wellbore 20 from a terranean surface 12 to one or more subterranean formations 40.

Method 300 can continue at step 304, which includes detecting rotational motion of the tool with one or more orientation sensors during the running. For example, the orientation sensor(s) 116 (such as, gyroscopes) detect an orientation of the downhole orientation tool 100 relative to the axis 103 (that runs through a centerline of the wellbore 20) during running (uphole or downhole). The measured orientation can be provided to or otherwise recorded by the controller 117.

Method 300 can continue at step 306, which includes logging a base log of orientation of the wellbore as a function of depth during the running. For example, the controller 117 (or a surface control system) can generate a log of the running of the downhole orientation tool 100 during steps 302 and 304, which can be an initial or base log of the wellbore 20, which records the measured orientation versus to depth of the downhole orientation tool 100 in the wellbore 20. This base log can also provide a wellbore shape (as a function of depth and measured orientation) and be used as a reference log for future logging runs with the downhole orientation tool 100.

In some aspects, step 306 can also include estimating a maximum mechanical force that is exerted on the downhole orientation tool 100, or force that the wellbore 20 can endure. The maximum mechanical force can be estimated based on, for example, input data regarding wellbore fluids, rock mechanics and geomechanics (for example, for an open hole wellbore), as well as wellbore tubing age/material/grade (for example, for a cased wellbore).

Method 300 can continue at step 308, which includes re-running the downhole tool in the wellbore to generate secondary log(s) of orientation of the wellbore as a function of depth. The duration between the base log and secondary log can be in days if different measurements are acquired, or months or years if the same type of measurements are acquired to monitor changes in the same measurement, such as time-lapse measurements. For example, step 308 can include one or multiple secondary logging runs with the downhole orientation tool 100 in the wellbore 20 (uphole or downhole). With each run, the orientation sensor 116 can detect the orientation of the downhole orientation tool 100 in the wellbore 20. Further, in some aspects, the secondary logging runs of step 308 can take into account the maximum mechanical force determined in step 306. The downhole orientation tool 100 can be oriented (for example, through operation of the orientation motor 118) to ensure that a force exerted on the downhole orientation tool 100 (or the wellbore 20) is less than the maximum mechanical force.

Method 300 can continue at step 310, which includes during the re-running, axially rotating at least a portion of the tool in the wellbore with an orientation motor to orient the tool at a particular axial orientation. For example, during the secondary logging runs of step 308, the orientation motor 118 can operate based on the measured orientation of the downhole orientation tool 100 to maintain the downhole orientation tool 100 at a particular axial orientation relative to axis 103. In some aspects, the base logging run of step 302 may not include operation of the orientation motor to maintain the downhole orientation tool 100 at the particular axial orientation. Therefore, each logging run can be different based on operation (or no operation) of the orientation motor 118. In some aspects, however, the orientation motor 118 can operate to rotate the downhole orientation tool 100 (or at least a portion thereof) to minimize a wellbore orientation difference between the base log of step 306 and secondary log(s).

Method 300 can continue at step 312, which includes generating a wellbore orientation index based on the base log and the secondary log(s). For example, the wellbore orientation index can represent a number between 0 and ±180 (i.e., 360 degrees), which represents a difference between a secondary log and the base log. Greater differences in the wellbore orientation index can mean, for example, that a wellbore tubular is corroded, or cementing has failed (in the case of a cased wellbore). As another example, greater differences in the wellbore orientation index can mean, for example, that the subterranean formation has changed, for example, geomechanically (in the case of an uncased wellbore).

Method 300 can continue at step 316, which includes determining material loss of a wellbore tubular. For example, during the base logging run, the caliper sub-assembly 124 can operate to measure radial dimensions of a wellbore tubular. Further, during the secondary logging runs, the caliper sub-assembly 124 can operate to re-measure the radial dimensions of the wellbore tubular (as they may change over time due to metal loss). The metal loss can then be determined, for example, by Eq. 1 (with the controller 117 for instance).

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole orientation tool, comprising:

a top sub-assembly configured to couple to a downhole conveyance and run into a wellbore on the downhole conveyance from a terranean surface to one or more subterranean formations, the top sub-assembly configured to couple to the downhole conveyance that is coupled to a logging tool uphole of the top sub-assembly;

one or more orientation sensors coupled to the top sub-assembly and configured to detect rotational motion of the tool during running in the wellbore;

an orientation motor coupled to the one or more orientation sensors and configured to axially rotate the tool in the wellbore in response to the detected rotational motion of the tool during running in the wellbore to orient the tool at a particular axial orientation during running in the wellbore; and a tractor coupled to the top sub-assembly, the one or more orientation sensors, and the orientation motor and configured to provide motive force to move the tool through the wellbore.

2. The downhole orientation tool of claim 1, comprising a multi-finger caliper sub-assembly coupled to the orientation motor and configured to measure an inner radial dimension of a wellbore tubular installed in the wellbore.

3. The downhole orientation tool of claim 2, comprising a flexibility spring coupled between the multi-finger caliper sub-assembly and the orientation motor, the flexibility spring configured to adjust an orientation of the multi-finger caliper sub-assembly in response to one or more external forces that act on the tool during running in the wellbore.

4. The downhole orientation tool of claim 1, comprising a centralizer coupled between the top sub-assembly and the tractor, the centralizer configured to radially centralize the tool in the wellbore during running in the wellbore.

5. The downhole orientation tool of claim 1, wherein the one or more orientation sensors comprises one or more gyroscopes configured detect the rotational motion of the tool during running in the wellbore.

6. The downhole orientation tool of claim 1, comprising a bottom sub-assembly configured to couple to a logging tool.

7. The downhole orientation tool of claim 1, wherein the tractor comprises a motor and a plurality of retractable arms, each retractable arm comprising at least one roller configured to exert the motive force on the wellbore or a wellbore tubular to move the tool through the wellbore in response to operation of the motor.

8. The downhole orientation tool of claim 2, comprising a controller communicably coupled to the one or more orientation sensors, the orientation motor, and the multi-finger caliper sub-assembly, the controller configured to perform operations comprising:

determining a metal loss of the wellbore tubular based on the measured inner radial dimension of the wellbore tubular, a baseline inner radial dimension of the wellbore tubular, a nominal outer radius of the wellbore tubular, and an average inner radial dimension of the wellbore tubular.

9. The downhole orientation tool of claim 8, wherein the operation of determining the metal loss comprises solving:

$$\text{Metal Loss } (TL) = \frac{IRMax_{MonitorLog} - IRMax_{BaseLog}}{OR_{nom} - IRAvg_{BaseLog}} \times 100,$$

where

Metal Loss (TL) is the metal loss of the wellbore tubular, $IRMax_{MonitorLog}$ is the measured inner radial dimension of the wellbore tubular, $IRMax_{BaseLog}$ is the baseline inner radial dimension of the wellbore tubular, $OR_{Nom}$ is the nominal outer radius of the wellbore tubular, and $IRAvg_{BaseLog}$ is the average inner radial dimension of the wellbore tubular.

10. The downhole orientation tool of claim 8, wherein the operations comprise generating a base log during an initial running of the tool in the wellbore, the base log comprising a log of wellbore orientation relative to wellbore depth exclusive of operation of the orientation motor.

11. The downhole orientation tool of claim 10, wherein the operations comprise generating at least one secondary log during at least one secondary running of the tool in the wellbore subsequent in time to the initial running of the tool in the wellbore, the at least one secondary log comprising a log of wellbore orientation relative to wellbore depth while operating the orientation motor to axially rotate the tool in the wellbore in response to the detected rotational motion of the tool during the at least one secondary running of the tool in the wellbore to orient the tool to minimize a wellbore orientation difference between the at least one secondary log and the base log.

12. The downhole orientation tool of claim 11, wherein the operations comprise generating an output that comprises a wellbore orientation index that defines the wellbore orientation difference between the at least one secondary log and the base log.

13. The downhole orientation tool of claim 12, wherein the wellbore orientation index is between 0 and ±180 degrees.

14. The downhole orientation tool of claim 11, wherein the at least one secondary log comprises a plurality of secondary logs, each of the plurality of secondary logs generated during a unique logging time subsequent in time to the initial running of the tool in the wellbore.

15. The downhole orientation tool of claim 1, wherein the downhole conveyance comprises a wireline.

16. A method, comprising:

running a downhole orientation tool on a downhole conveyance into a wellbore from a terranean surface to one or more subterranean formations, the downhole orientation tool comprising:

one or more orientation sensors, an orientation motor coupled to the one or more orientation sensors, a tractor coupled to the top sub-assembly, the one or more orientation sensors, and the orientation motor and configured to provide motive force to move the tool through the wellbore, and a controller communicably coupled to the one or more orientation sensors, the orientation motor, and the multi-finger caliper sub-assembly;

during the running, detecting rotational motion of the tool with the one or more orientation sensors;

in response to the detected rotational motion of the tool during running in the wellbore, axially rotating at least a portion of the tool in the wellbore with the orientation motor to orient the portion of the tool at a particular axial orientation during running in the wellbore;

measuring an inner radial dimension of a wellbore tubular installed in the wellbore with a multi-finger caliper sub-assembly coupled to the orientation motor;

determining, with the controller, a metal loss of the wellbore tubular based on the measured inner radial dimension of the wellbore tubular, a baseline inner radial dimension of the wellbore tubular, a nominal outer radius of the wellbore tubular, and an average inner radial dimension of the wellbore tubular; and generating, with the controller, a base log during an initial running of the tool in the wellbore, the base log comprising a log of wellbore orientation relative to wellbore depth exclusive of operation of the orientation motor.

17. The method of claim 16, comprising adjusting an orientation of the multi-finger caliper sub-assembly in response to one or more external forces that act on the tool during running in the wellbore with a flexibility spring coupled between the multi-finger caliper sub-assembly and the orientation motor.

18. The method of claim 16, comprising radially centralizing the tool in the wellbore during running in the wellbore with a centralizer coupled between the top sub-assembly and the tractor.

19. The method of claim 16, wherein detecting rotational motion of the tool with the one or more orientation sensors comprises detecting rotational motion of the tool with one or more gyroscopes.

20. The method of claim 16, comprising, during running the downhole orientation tool on the downhole conveyance into the wellbore, logging the wellbore with a logging tool coupled to at least one of the downhole conveyance or the downhole orientation tool.

21. The method of claim 16, comprising moving the downhole orientation tool through the wellbore with the tractor.

22. The method of claim 21, wherein moving the downhole orientation tool through the wellbore with the tractor:

extending a plurality of retractable arms of the tractor to contact an inner radial surface of the wellbore or a wellbore tubular;

operating a motor of the tractor to operate at least one roller on each retractable arm that is in contact with the wellbore or the wellbore tubular; and exerting motive force on the wellbore or the wellbore tubular to move the tool through the wellbore with the rollers.

23. The method of claim 16, wherein determining the metal loss comprises solving, with the controller:

$$\text{Metal Loss } (TL) = \frac{IRMax_{MonitorLog} - IRMax_{BaseLog}}{OR_{nom} - IRAvg_{BaseLog}} \times 100,$$

where

Metal Loss (TL) is the metal loss of the wellbore tubular, $IRMax_{MonitorLog}$ is the measured inner radial dimension of the wellbore tubular, $IRMax_{BaseLog}$ is the baseline inner radial dimension of the wellbore tubular, $OR_{Nom}$ is the nominal outer radius of the wellbore tubular, and $IRAvg_{BaseLog}$ is the average inner radial dimension of the wellbore tubular.

24. The method of claim 16, comprising generating, with the controller, at least one secondary log during at least one secondary running of the tool in the wellbore subsequent in time to the initial running of the tool in the wellbore, the at least one secondary log comprising a log of wellbore orientation relative to wellbore depth while operating the orientation motor to axially rotate the tool in the wellbore in response to the detected rotational motion of the tool during the at least one secondary running of the tool in the wellbore to orient the tool to minimize a wellbore orientation difference between the at least one secondary log and the base log.

25. The method of claim 24, comprising generating, with the controller, an output that comprises a wellbore orientation index that defines the wellbore orientation difference between the at least one secondary log and the base log.

26. The method of claim 25, wherein the wellbore orientation index is between 0 and ±180 degrees.

27. The method of claim 24, wherein the at least one secondary log comprises a plurality of secondary logs, each of the plurality of secondary logs generated during a unique logging time subsequent in time to the initial running of the tool in the wellbore.

28. A method, comprising:

running a downhole orientation tool on a downhole conveyance into a wellbore from a terranean surface to one or more subterranean formations, the downhole orientation tool comprising:

one or more orientation sensors, an orientation motor coupled to the one or more orientation sensors, a tractor coupled to the top sub-assembly, the one or more orientation sensors, and the orientation motor and configured to provide motive force to move the tool through the wellbore, a controller communicably coupled to the one or more orientation sensors, the orientation motor, and the multi-finger caliper sub-assembly;

during the running, detecting rotational motion of the tool with the one or more orientation sensors; and in response to the detected rotational motion of the tool during running in the wellbore, axially rotating at least a portion of the tool in the wellbore with the orientation motor to orient the portion of the tool at a particular axial orientation during running in the wellbore;

measuring an inner radial dimension of a wellbore tubular installed in the wellbore with a multi-finger caliper sub-assembly coupled to the orientation motor;

determining, with the controller, a metal loss of the wellbore tubular based on the measured inner radial dimension of the wellbore tubular, a baseline inner radial dimension of the wellbore tubular, a nominal outer radius of the wellbore tubular, and an average inner radial dimension of the wellbore tubular, wherein determining the metal loss comprises solving, with the controller:

$$\text{Metal Loss } (TL) = \frac{IRMax_{MonitorLog} - IRMax_{BaseLog}}{OR_{nom} - IRAvg_{BaseLog}} \times 100,$$

where

Metal Loss (TL) is the metal loss of the wellbore tubular, $IRMax_{MonitorLog}$ is the measured inner radial dimension of the wellbore tubular, $IRMax_{BaseLog}$ is the baseline inner radial dimension of the wellbore tubular, $OR_{Nom}$ is the nominal outer radius of the wellbore tubular, and $IRAvg_{BaseLog}$ is the average inner radial dimension of the wellbore tubular.

* * * * *